United States Patent [19]

Moore

[11] Patent Number: 4,598,185

[45] Date of Patent: Jul. 1, 1986

[54] UNIVERSAL CENTRIFUGAL SWITCH ASSEMBLY

[75] Inventor: Harry O. Moore, Charlotte, N.C.

[73] Assignee: Chris Combis, Charlotte, N.C.; a part interest

[21] Appl. No.: 760,020

[22] Filed: Jul. 29, 1985

[51] Int. Cl.[4] ..... H01H 35/10

[52] U.S. Cl. ..... 200/80 R; 310/68 E; 318/793

[58] Field of Search ..... 200/80 R, 85 R; 318/793, 361, 462, 542; 310/68 E, 148, 151; 73/535-538

[56] References Cited

U.S. PATENT DOCUMENTS

| | | | |
|---|---|---|---|
| 945,997 | 1/1910 | Wiard | 318/793 |
| 1,024,807 | 4/1912 | Ray | 318/793 |
| 2,187,207 | 1/1940 | McCabe | 318/793 |
| 4,377,731 | 3/1983 | Georgelin | 318/793 |

FOREIGN PATENT DOCUMENTS

| | | | |
|---|---|---|---|
| 587960 | 11/1933 | Fed. Rep. of Germany | 200/80 R |
| 432540 | 12/1911 | France | 200/80 R |

*Primary Examiner*—G. P. Tolin

*Attorney, Agent, or Firm*—Ralph H. Dougherty

[57] ABSTRACT

A centrifugal switch for preventing overspeed of a rotary shaft driven by an electrical motor is arranged to open the electrical circuit to the starting windings at a predetermined speed of rotation. A split slip ring arrangement is engaged by metallic conducting elements urged into the conductive position by a compression means, which, when the compressive force is overcome, allows the contacts to move outward from the slip ring, to break the electrical contact. The critical rotational speed can be readily adjusted by changing the weight of the metallic conducting elements or by changing the tensile force of the compression spring.

10 Claims, 8 Drawing Figures

UNIVERSAL CENTRIFUGAL SWITCH ASSEMBLY

BACKGROUND OF THE INVENTION

This invention relates to a centrifugal switch for a rotary shaft driven by an electric motor. More particularly, the invention relates to a centrifugal switch for opening a circuit at a predetermined speed of rotation, preferably about 200 revolutions per minute below synchronous speed of the motor. Such a switch opens the circuit to the starter windings upon the motor shaft attaining a predetermined rotational velocity, whereupon the motor continues to receive power input only through the running windings.

Heretofore, other types of prior art centrifugal switches have required that metallic contact slip rings and bushes continuously move in relative sliding interengagement at all times during operation of the motor to insure that the starting winding would be effective during acceleration of the motor. Thus the bushes and/or slip rings would become worn beyond use quite rapidly and the bushes could not then be maintained in positive engagement with the slip rings because of inefficiencies in sensing and controlling the rotational speed of the shaft in a predetermined manner.

Magnetically-operated centrifugal switches utilizing an attraction between opposite poles of two opposing and adjacent magnets for maintaining a circuit and relying upon centrifugal force to separate the magnets and consequently deactivate a circuit have also heretofore been known and used, but this type of switch can develop an accumulation of dirt or grime on the faces of the opposing magnetic poles over time which will detrimentally affect the performance of the switch. The magnetically-operated centrifugal switch known heretofore has a tendency, due to accumulation of dirt and grime, to activate or deactivate an associated circuit prematurely since the centrifugal force will then more readily act to separate the opposed magnets thereof.

The centrifugal switch of the present invention overcomes the problems associated with the prior art switches. Magnets are not utilized in the present switch and the slip rings and bushes do not have to move continuously in relative sliding interengagement at all times during operation of the motor. Furthermore, the switch is of a standardized construction which will fit substantially all electric motors of the same shaft diameter. In addition, while in the operative position, two brushes are always in contact with each slip ring, which will carry the load very effectively.

OBJECTS OF THE INVENTION

It is the principal object of this invention to avoid and overcome the foregoing and other difficulties of and objections to prior art practices by the provision of integral, unitary switch activating device which reliably actuates a switch at a predetermined angular velocity of a shaft.

Another object of this invention is to provide a compact and efficient centrifugal switch assembly adapted to be fixed on the rotor shaft of an electric motor and wherein a stationary split ring assembly is provided to which electrical conductors may be permanently attached, and wherein a centrifugally operated metallic conducting element are arranged to rotate with said shaft and relative to said split ring assembly and contacts the split ring assembly during only the acceleration and deceleration periods of the rotor, thus prolonging the useful life of the metallic conducting elements as compared to the known prior art centrifugal switches.

It is a more specific object of this invention to provide a centrifugal switch assembly of the type described in which stationary split rings are fixed on a base plate, in which the rotor shaft of an electric motor is journaled, an electric motor, the switch having a spider ring with at least four radial openings extending through the ring, a metallic conducting element positioned in each of the openings, with spring means biasing the metallic conducting elements toward the split ring assembly.

It is also an object of this invention to provide a centrifugal switch assembly of the type last described without the use of magnetic means for biasing the conducting means toward the operative position.

BRIEF SUMMARY OF THE INVENTION

The aforesaid objects of this invention, and other objects which will become apparent as the description proceeds, are achieved by providing an improved centrifugal switch wherein a split slip ring arrangement is engaged by metallic conducting elements urged into the conductive position by compression means, which, when the compressive force is overcome, allows the contacts to move outward from the slip ring, to break the electrical contact. The critical rotational speed can be readily adjusted by changing the weight of the metallic conducting elements or by changing the tensile force of the compression spring.

BRIEF DESCRIPTION OF THE DRAWINGS

For a better understanding of this invention, reference should be made to the accompanying drawings, wherein like numerals of reference indicate similar parts through the several views and wherein.

DETAILED DESCRIPTION

Figure 8:
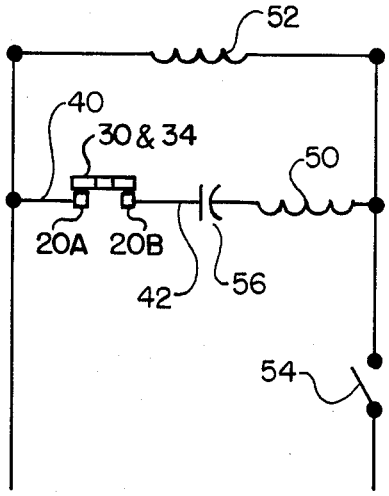
FIG. 8 is a schematic drawing of the circuitry associated with the invented switch.

With specific reference to the form of the invention as illustrated in the drawings, and referring particularly to FIG. 8, a centrifugal switch is indicated generally by the reference numeral 10.

As is well known, in the starting of a motor of the split phase of capacitive type (the latter being shown in FIG. 8), the current is first supplied to both the starting stator windings 50 and the running stator windings 52, and when the motor speed increases to a predetermined rotational velocity, the current flow to the starting stator windings is interupted by opening the switch 10 in the circuit, leaving the motor to run only on the power provided by the running windings, until such time as either the motor is loaded above its capacity, or the running winding is opened at its terminals or master switch 54.

Figure 1:
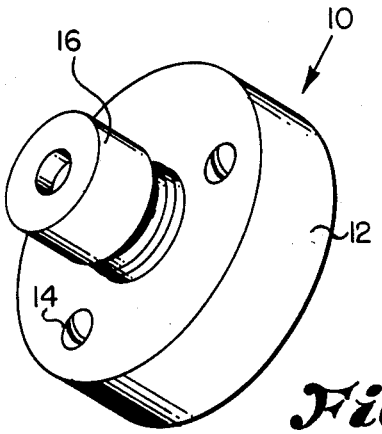
FIG. 1 is a perspective view of the non-magnetic centrifugal switch showing the cup-shaped housing mounted on a rotatable shaft.
Figure 3:
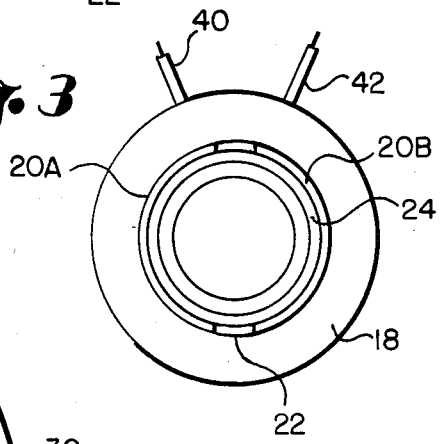
FIG. 3 is a bottom of the portion of the switch assembly shown in FIG. 2.

The invented switch assembly, broadly designated as 10 in FIG. 1, which has a cup-shaped non-metallic housing 12, is employed to supply current to the starting stator winding to start the motor, and to cease current flow to the starting windings when the motor reaches a predetermined speed. The components of the switch are enclosed by housing or casing 12 and held enclosed by screws 14 which fix the orientation of the components of switch 10, and allow it to be fixed onto a rotor shaft 16. A split slip ring assembly, best shown in FIG. 3, comprises a base plate 18, two almost semi-circular slip rings 20A and 20B, mounted on the base 18 and separated from each other in insulated relationship by a non-conductive material, such as nylon or non-conductive plastic, in the gap or space 22 between the slip rings to form a complete ring, with the non-conductive material forming an interior coating or tube 24 in the slip ring assembly. A pair of spaced O-rings 26A and 26B are positioned in the a pair of recesses in the interior of the tube 24 and having a suitable grease packed between the O-rings to act as the bearing surface for the rotor shaft to be journaled therein. If desired, a recess can be provided in the surface of the non-conductive material between the two O-rings 26 for accomodating a greater amount of grease than just a modest coating on that surface.

The rotatable shaft 16 is mounted within housing 12. Fixed to the housing and centered about the rotor shaft 16 is a spider ring 30 having a plurality of equally spaced radial openings 32 (preferably 6). A conducting element or brush 34 is situated and radially movable within each opening 32 in the spider ring. The outer edge of the spider ring preferably contains an annular groove 36 for receiving a compression means such as an endless spring 38. The spring has a predetermined tension which acts on the conducting elements 34 to urge them inward. The elements themselves could be termed governor weights. Six elements are preferred. Fewer conducting elements can be utilized, if desired, but no fewer than four are recommended. The conducting elements preferably have a round cross section, as other shapes such as oblong, rectangle or square tend to twist within the opening 32 in the spider ring and "lock", often resulting in a broken spider ring.

The base 18 includes electrical leads 40 and 42, one of which is connected to each of the semi-circular slip rings 20A and 20B. When rotor shaft 16 is at rest, the centrifugal switch assembly 10 normally establishes contact between the pair of conductors or electrical leads 40 and 42 of FIG. 2, which are connected to a source of electrical energy, not shown. Conductor 40 is connected to a lead conductor extending from one end of the running stator winding to one side of a suitable source of alternating current, not shown. The other end of the running stator winding and the corresponding end of the starting stator winding are connected to a lead conductor. Conductor 42 leads from the centrifugal switch assembly 10 to the end of the starting stator winding opposite from the lead conductor, not shown. In the event that the motor is of the capacitive type, a suitable capacitor 56 may be interposed in conductor 42, as shown in FIG. 8.

Figure 4:
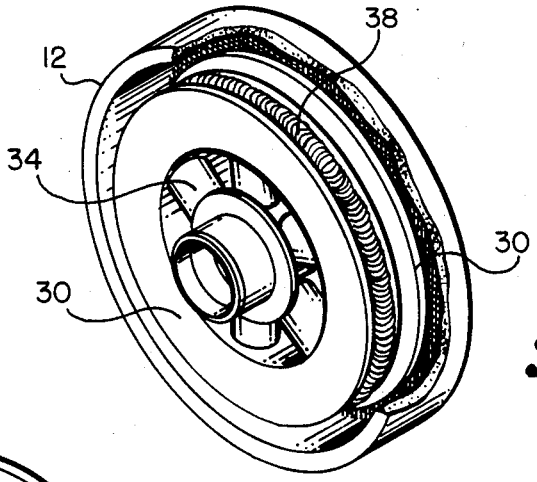
FIG. 4 is a partially cut away perspective view of the switch components mounted on a rotating shaft.
Figure 5:
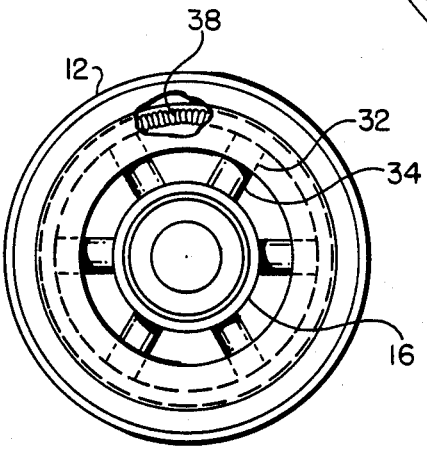
FIG. 5 is a partially cut away side view illustrating the positions of the switch components of FIG. 4 in the operative position.

As shown in FIGS. 4 and 5, the metallic conducting elements 34 extend beyond the inner and outer edges of spider ring 30. The centrifugal force exerted on the switch 10 by the rotating shaft 16 forces metallic conducting elements 34 to overcome the tension of spring 38, and snap the switch to the open position, breaking the electrical contact. The metallic conducting elements 34 are held into position by compression spring 38 and further restricted by the housing 12. Rotation of the shaft 16 carries with it the housing 12 and the spider ring 30, including the switch components. When rotor shaft 16 and slip rings 20A & B are at rest or rotating at a relatively slow speed in the course of acceleration thereof, the slip rings are engaged by metallic conducting elements 34, which are preferably made from copper, bronze, or stainless steel. Spider ring 30 is preferably made from copper, brass, aluminum, bronze, or steel. The slip rings 20A and 20B may be made from any suitably conductive material.

Figure 6:
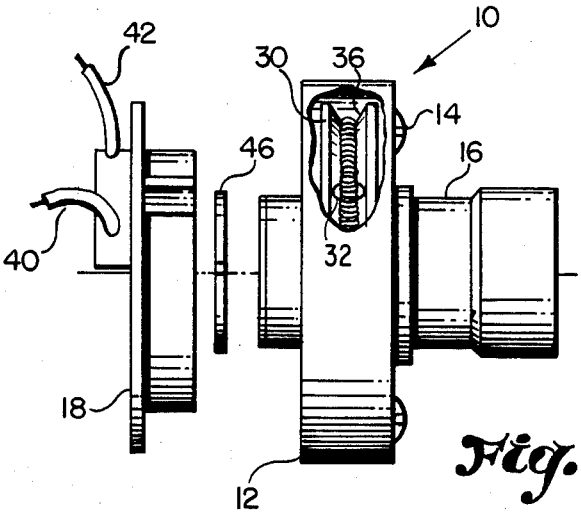
FIG. 6 is a partially exploded, partially cut away side elevational view of the invented switch.

When the centrifugal switch is assembled, a lock ring 46, shown in FIG. 6, is placed in a groove, not shown, in shaft 16 as a retainer for base plate 18, to maintain all of the switch components in proper relation.

Figure 2:
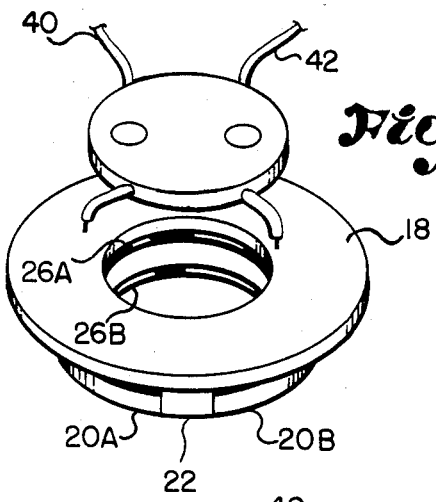
FIG. 2 is a schematic isometric view of a portion of the split ring switch assembly showing electrical connections and bearing means for the rotor shaft.
Figure 7:
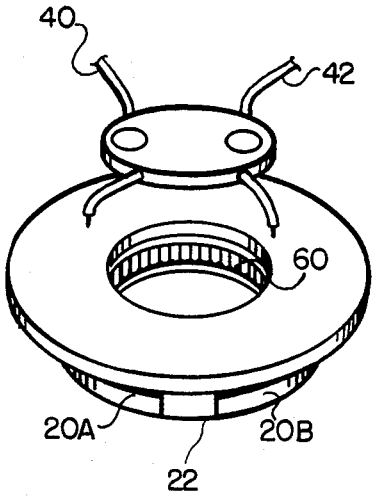
FIG. 7 is an isometeric view similar to FIG. 2 showing an alternative bearing means embodiment.

As an alternative embodiment, the bearing means, shown in FIG. 2 as 0-rings with grease between them, could be a roller bearing 60, as shown in FIG. 7, fixed into position within the tube 24 of insulation material, wherein the shaft 16 would be journaled.

In operation, when the rotor shaft 16 is at rest, the metallic conducting elements 34 occupy the closed position shown in FIG. 5 and maintain contact with slip rings 20A and 20B. The spring 38 maintains the metallic conducting elements 34 in the radially inward or closed position so that when the master switch 54 is initially closed, the centrifugal switch 10 supplies current to the starting stator winding 50. As the speed of rotor shaft 16, spider ring 30 and metallic conducting elements 34 increases, the centrifugal force acting against spring 38 overcomes its compressive strength, and causes the metallic conducting elements 34 to move outwardly. In so doing, the metallic conducting elements 34 cease to contact the slip rings and assume the inoperative position.

In summary, the conducting elements are forced into contact with the slip rings by the compression spring, passing current through one slip ring, through the conductor elements into the spider ring, and back through conductor elements into the other slip ring, completing the circuit. Upon the rotation of the shaft reaching a predetermined number of revolutions per minute, the weight of the contacting elements will overcome the compressive force of the compression spring 38, and the starting circuit will be broken, leaving the motor to run only on the running windings. The current never reaches spring 38, as it moves by the path of least resistance through spider ring 30, which acts to protect the spring. The gap 22 between the slip rings 20A and 20B is greater than the width of a conducting element 34, which prevents spanning the gap by a single element and arcing or shorting across the gap, burning the element.

The predetermined switch setting can be changed by selecting a compression spring 38 having a different compressive force, by changing the weight of the conductive elements, or by doing both. The present invention includes both the electrical contacts and the governor means in a single housing.

The invented switch has been tested in 45,000 starts and stops without failure, and without the replacement of any components.

It is readily seen from the foregoing that I have provided a universal centrifugal switch with movable metallic conducting elements extending through a spider ring to engage a split slip ring, mountable on a rotatable shaft, by which, upon the speed of the shaft reaching a predetermined rate, the metallic conducting elements move outwardly away from the split ring to break the electrical contact. The switch is universal, as it will work on any motor as long as the speed requirements are met.

In the drawings and specification there has been set forth a preferred embodiment of the invention and although specific terms are employed, they are used in a generic descriptive sense only and not for purposes of limitation, the scope of the invention being defined only by the appended claims.

What is claimed is:

1. A universal centrifugal switch assembly, comprising: a fixed base provided with a hole centered therein;

a pair of spaced apart, substantially semicircular, slip rings of the same diameter fixed onto said base concentric with the hole in said base, said slip rings defining a pair of spaces between their ends;

non-conducting insulating material fixed within said slip rings and located in said spaces between said slip rings and forming a tubular receptacle within and concentric with said rings;

a rotatable shaft journaled within said tubular receptacle;

bearing means carried by and within said tubular receptacle between said tubular receptacle and said shaft;

a spider ring housing fixed to said rotatable shaft;

a spider ring connected to said spider ring housing, said spider ring being provided with a plurality of radial openings for accommodating conducting elements therein;

a plurality of conducting elements, on positioned in each radial opening in said spider ring and extending radially outwardly from said shaft;

compression means circumscribing said spider ring, said compression means having a predetermined tension, whereby said compression means acts in the operative mode to urge said conducting elements into engagement with said slip rings until overcome by centrifugal force.

2. A universal centrifugal switch assembly according to claim 1 wherein the space between said slip rings filled by non-conducting material is greater than the width of one conducting element.

3. A switch assembly according to claim 1 wherein said spider ring is provided with an outer annular groove receiving said compression means.

4. A switch assembly according to claim 1 wherein said compression means is an endless compression spring encircling said spider ring and engaging said conducting elements.

5. A switch assembly according to claim 1 wherein said conducting elements are evenly spaced about the circumference of said spider ring.

6. A switch assembly according to claim 1 wherein said bearing means comprises a pair of spaced O-rings within said non-conducting material and receiving said rotatable shaft therein, the grease packed between said spaced O-rings.

7. A switch assembly according to claim 1 wherein said bearing means is a roller bearing carried by said tubular receptacle which journals said shaft in insulated relation with said slip rings.

8. A switch assembly according to claim 1 wherein said conducting elements are constructed from a material selected from the group comprising copper, bronze, and stainless steel.

9. A switch assembly according to claim 1 wherein the construction material of said spider ring is selected from the group comprising aluminum, bronze, brass, copper, and steel.

10. A switch assembly according to claim 1 wherein said insulation material is selected from the group comprising nylon and non-conducting plastic.

* * * * *